US011524424B2

(12) United States Patent
Laplante et al.

(10) Patent No.: US 11,524,424 B2
(45) Date of Patent: Dec. 13, 2022

(54) PRODUCTION OF ORIENTED STRAND BOARD

(71) Applicant: NORBORD INC., Toronto (CA)

(72) Inventors: Alain Laplante, Ville Saint-Laurent (CA); Mathieu Thibault, Ville Saint-Laurent (CA); Aleksander Nadezhdin, Ville Saint-Laurent (CA)

( * ) Notice: Subject to any disclaimer, the term of this patent is extended or adjusted under 35 U.S.C. 154(b) by 4 days.

(21) Appl. No.: 16/536,574

(22) Filed: Aug. 9, 2019

(65) Prior Publication Data

US 2020/0047371 A1 Feb. 13, 2020

Related U.S. Application Data

(60) Provisional application No. 62/717,214, filed on Aug. 10, 2018.

(51) Int. Cl.

| | |
|---|---|
| ***B27N 3/02*** | (2006.01) |
| ***B27N 3/08*** | (2006.01) |
| ***B27N 3/20*** | (2006.01) |
| ***B27N 3/00*** | (2006.01) |

(52) U.S. Cl.

CPC ..... *B27N 3/20* (2013.01); *B27N 3/002* (2013.01); *B27N 3/02* (2013.01); *B27N 3/083* (2013.01); *B27N 3/086* (2013.01)

(58) Field of Classification Search

CPC . B27N 3/002; B27N 3/02; B27N 3/04; B27N 3/086; B27N 3/12; B27N 3/16; B27N 3/18; B27N 3/20; B27N 3/203; B27N 3/08; B27N 3/083; B27N 3/10; B27N 3/14; B27N 3/143; B27N 3/183; B27N 3/22

See application file for complete search history.

(56) References Cited

U.S. PATENT DOCUMENTS

| | | | | |
|---|---|---|---|---|
| 3,542,629 | A * | 11/1970 | Burkner | B27N 3/22 156/558 |
| 4,065,003 | A * | 12/1977 | Hostettler | B27N 3/22 414/277 |
| 5,063,010 | A * | 11/1991 | Fischer | B27N 3/086 264/109 |
| 5,762,980 | A * | 6/1998 | Bielfeldt | B27N 3/18 425/371 |
| 6,470,940 | B1 * | 10/2002 | Pu | B05B 7/30 118/690 |
| 6,649,098 | B2 | 11/2003 | Mente et al. | |
| 8,058,193 | B2 * | 11/2011 | Clark | B27N 3/083 442/413 |
| 8,486,523 | B2 | 7/2013 | Mente | |
| 2015/0054205 | A1 | 2/2015 | Costa et al. | |
| 2016/0215144 | A1 | 7/2016 | Mente | |
| 2017/0151758 | A1 | 6/2017 | Lollar et al. | |

* cited by examiner

*Primary Examiner* — Michael A Tolin

(74) *Attorney, Agent, or Firm* — Slater Matsil, LLP

(57) ABSTRACT

A method of making a wood particle board containing sticking type resin coated wood particles wherein the top of a layup of the coated wood particles is smoothed to provide a smooth a top surface on the layup and a release agent is applied on the top surface and the so coated layup is consolidated into a board in a consolidating press under heat and pressure with the coated top surface in direct contact with a press platen.

15 Claims, 2 Drawing Sheets

PRODUCTION OF ORIENTED STRAND BOARD

CROSS REFERENCE TO RELATED APPLICATIONS

This application claims priority from U.S. Provisional Application No. 62/717,214 filed: Aug. 10, 2018.

STATEMENT REGARDING FEDERALLY SPONSORED RESEARCH OR DEVELOPMENT

Not Applicable

REFERENCE TO MICROFICHE APPENDIX

Not Applicable.

FIELD OF INVENTION

The present invention relates to the production of consolidated wood particle panels such as oriented strand board (OSB) more particularly to production of such boards wherein a resin that sticks to a pressing platen during consolidation such as a isocyanate resin preferably a polymeric diphenylmethane diisocyanate (pmdi) is used as the binding resin in the surface layer engaging with the pressing platen and preferably in all the layers of the board.

BACKGROUND OF THE PRESENT INVENTION

The invention relates to the production wood based composite panels made by pressing (also called "cooking") wood particles (also called lignocellulose material, including flakes wafers or strands blended with the adhesive and formed into a mat (layup). The adhesive is activated by heat and pressure to consolidate the layup. The wood mat is pressed between the steel (ordinary or stainless) platens or belts for a given amount of time, then pushed out as the finished product or a substrate for further lamination to its surface. As one of the preferred adhesives, a sticking type resin i.e. a resin that sticks to the press platen during consolidation e.g. an isocyanate resin such as a polymeric diphenylmethane diisocyanate (pmdi) which will strongly adhere itself to the metal surface of the aforementioned can a superior product at a lower cost than other non-sticking resins such as phenolic resins. Sticking type resins may only be used commercially with some form of protection to prevent or significantly reduce such sticking to a commercially acceptable level. Currently used or proposed solutions either isolate the sticking type resin from the press platens before pressing by a barrier, for example interposing a release agent between the press platen and the layup being consolidated, or neutralised by a reactive chemical capable of successful competition with metal for the active binding sites of the adhesive (see for example US application 2016215144, and U.S. Pat. Nos. 8,486,523 and 6,649,098).

In practise the when a release agent is used to overcome this well-known problem it must be used in significant quantities which ads significantly to the cost of production and in most cases causes significant corrosive damage to the carbon steel press platen which add significantly more to the cost of production.

During the wood flake mat (layup) is transported to and evacuated from the press by the means of a caul screen sitting below its bottom surface. This presents a problem specific to the top face release from the top steel platen since the release spray to protect the metal surface from the adhesive-laden mat has to be applied directly on the top surface of the uneven flake mat. This requires a substantial amount of release in order to cover all surfaces of wood strands which might be shadowed or even hidden from direct impact of the release liquid spray due to strands curling or matting. Only by drastically increasing the spray application rate, coverage of the contact surfaces is complete, which results in a substantial additional cost to the sticking adhesive e.g. pmdi-based OSB production. The release of the bottom surface is much facilitated by one's ability to spray the caul screen before wood mat is laid on it. This problem is exacerbated in batch production in a conventionally designed stack (multi-opening) presses This sticking problem has been addressed by others suggesting other ways of minimising sticking see for example see for example US Patent Application 2015/00542205 published Feb. 26, 2015 Costa et al. and 2017/0151758 published Jun. 1, 2017 Lollar et al.

BRIEF DESCRIPTION OF THE PRESENT INVENTION

It is an object of the present invention to provide an improved system (method and/or apparatus) for the production of wood particle board such as OSB using a sticking type resin i.e. isocyanate resin preferably pmdi as the binding resin and significantly reducing the amount of release agent required to protect the press platen.

Broadly the present invention relates to a method and apparatus for the manufacture of wood particle boards such as OSB wherein the binding resin is a sticking type resin such as pmdi while significantly reducing the amount of release agent required to eliminate or reduce sticking in the consolidating press to an acceptable level.

Broadly the present invention relates to method of making a wood particle board comprising forming a layup containing sticking type resin coated wood particles, smoothing a top surface of said layup, applying a release agent to produce said top surface coated with said release agent and pressing said layup in a press with said coated top surface in direct contact with a press platen to consolidate said layup under heat and pressure to consolidate said layup into a board.

More specifically the present invention relates to a method of making oriented strand board (OSB) containing a sticking type resin that adheres to a metal surface of a press platen in a surface layer used to form a smooth surface of said board comprising forming a layup of strand layers formed with resin coated strands with said surface layer forming a top of said layup containing said sticking type resin providing a top surface of said layup, smoothing said top surface of said layup without causing significant sticking of said resin to said smoothing device to provide a smoothed top surface, applying a release agent to said smoothed top surface to provide a release agent coated top surface, consolidating said layup in a consolidating press with said coated top surface in contact with a smooth platen of said consolidating press to form said oriented strand board and removing said board from said consolidating press.

Preferably said smoothing comprises prepressing said layup.

Preferably said prepressing comprises steam prepressing.

Preferably said smoothing of said to surface of said layup comprises prepressing said layup in steam press.

Preferably said prepressing reduces the initial mat height by 20 to 80%, and using steam dosage per unit area between 0 and 140 g/square meter.

The method of making oriented strand board as defined in claim 2 wherein said prepressing comprises reducing the initial mat height by the value between 50 and 67%, while applying a steam dosage between 80 and 120 g/square meter.

Preferably the sticking type resin is an isocyanate resin.

Preferably the sticking type resin is a polymeric diphenylmethane diisocyanate (pmdi) resin.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
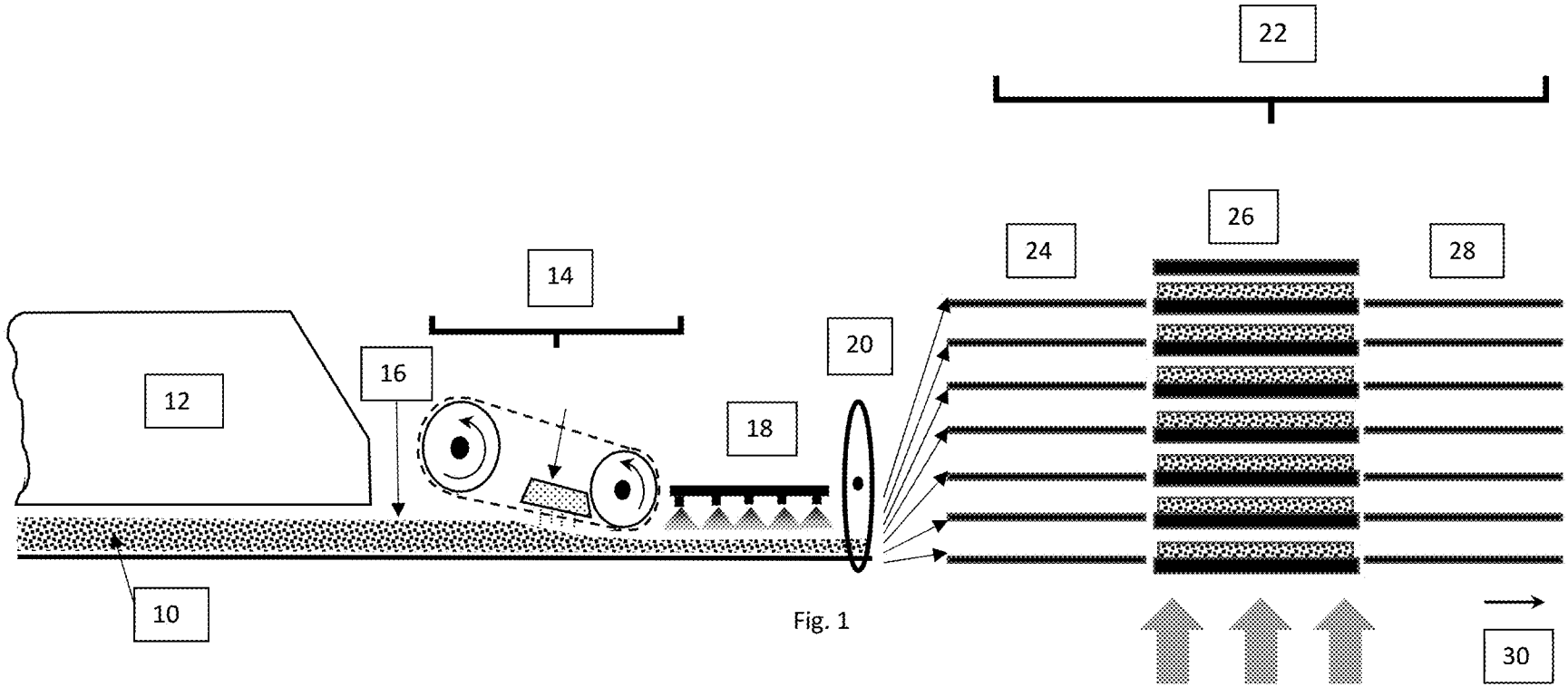
FIG. 1 is a schematic illustration of the invention applied to multi-opening press production of OSB.

As shown in FIG. 1 in practising the present invention when using a multi opening press a layup 10 is formed in the conventional manner in a forming station 12 and passes through a smoothing station 14 wherein the upper surface 16 of the layup 10 is smoothed, as will be described in more detail below. The layup with its upper surface smooth is then passed to a coating station 18 where it is coated with a release agent, in the illustrated system by spraying but any suitable coating techniques may be used. The layup 10 with its smoothed upper surface coated with release agent is then cut as indicated by a conventional cutter mechanism schematically indicated at 20 into discrete lengths to form individual panel portions which are sent to the consolidation station 22 conventional loader 24 which feeds the panel portions in the conventional manner into the multi-opening press 26 where the panels are compressed under heat and pressure to consolidate the panes into the desired consolidated panel and a standard unloader 28, which, after consolidation unloads the individual panels from the press 26 in the normal manner. The consolidated panels leave the production line as indicated by the arrow 30. In effect the processing steps of forming the layup 10 in the forming station 12 and pressing the panels to consolidate same in the consolidating station 22 using the loader 24 press 26 and unloader 28 are common to most if not all manufacturing process for making wood particle boards such as OSB. The addition of the smoothing station 14 and release agent applying station 18 in sequence and interposed between the forming station 12 and consolidating station 22 that provides the improved method and apparatus of present invention.

The smoothing station may take different forms but preferably will be a steam type pre pressing operation wherein the top surface 16 of the layup 10 is smoothed in this case by flattening surface preferably using an ironing technique. As this invention is for the manufacture of wood particle boards, preferably OSB using sticking type resins it is important that the condition in the smoothing station 14 not cause sticking of the resin to the surfaces of the smoothing station used to smooth the top surface 16 of the layup or premature setting of the resin being used to a degree that would interfere with production of a consolidated board or panel having the required characteristic. The specific condition in the prepress to ensure significant sticking of said resin to said smoothing device and premature setting of the resin do not occur will be resin dependent and known in the art.

Any suitable smoothing device for example steam preheaters as described above and schematically shown in FIG. 1 consisting of a semi-permeable forward tilted short loop top belt that applies a slight top pressure to the mat moving therethrough towards the press loader, with the steam chamber supplying the steam through the belt to the mat uniformly across the wood flow direction so that the ironing action is thereby effected. The required pressure is small on the scale of OSB production so that it is better to define pressure by change (reduction) in mat height such reduction in mat height will be height reduction between 20% and 80% of the original thickness of the mat or layup while the amount of steam applied will be between 0 and 150 g/square meter of the mat or layup surface area.

In a more preferred operating range, the mat thickness reduction will be between 50% and 67% and the steam dosage will be between 80 and 120 g/square meter of the mat or layup surface area.

Most if not all current installations have apple room between the layup forming station 12 and the consolidating station 22 to accommodate known commercial steam prepressing devices 14 and in sequence with the coating station 18. The time of contact between the steaming portion of the smoothing device 12 and the top surface 16 of the layup in current installation is normally between 2 and 6 seconds. This contact time will be optimised for any given installation of the present invention.

Sticking type resins intended to be used with the present invention are isocyanate type resins more preferably polymeric diphenylmethane diisocyanate (pmdi) based adhesive formulations.

It will be apparent from the experimental results reported below a significant reduction in the amount of release agent required can be attained which will dependent to some degree on the specific release agent chosen, but it is expected that reduction in the amount of release agent required may be reduced by at least 30% and probably as much as about 50%.

In order to prove the effectiveness of the present invention a number of experiments were preformed as outlined below and which prove the effectiveness of the present invention are described below.

In a series of laboratory scale tests it was clearly demonstrated that flattening or smoothing of the top layer of the OSB flake mat leads to considerable reduction of the minimum required release application rate for a clean release of consolidated board for OSB production in a multi-daylight press where pMDI is used as a sole adhesive. The range of steam addition used to achieve the desired release reduction was between 0 and 140 g/m2 which could be supplied by one of the readily available commercial devices for steam pre-heating of the wood flake mat. Experimental program and results verifying the effectiveness of the present invention follows.

The flattening method which was used as an example for this invention is the "steam-ironing" principle which has already been used in panel board applications for different purposes, none of which related to the reduction in release application. In order to verify this principle, a simple assembly was used in the lab utilising a lab press where wood mat with resin is consolidated by heat and pressure under reproducible conditions which include temperature, pressure profile of the press cycle, speed of closure and decompression sequence, as shown in Table 1.

TABLE 1

Standard conditions for single layer panel (initial wood moisture content 5%)

| | | | | |
|---|---|---|---|---|
| Thickness of consolidated product | | 7/16 | 1/4 | inch |
| Press load | | 4500 | 4500 | MPa |
| Density (Aspen) | | 38 | 38 | Pcf |
| Platen temperature | | 215 | 215 | ° C. |
| pmdi dosage | | 2.8 | 2.8 | % |
| Wax dosage | | 1.0 | 1.0 | % |
| Press cycle | Closing time | ~45 | ~45 | Second |
| | Cooking time | 160 | 280 | Second |
| | Degas | 0 | 0 | second |

Figure 2:
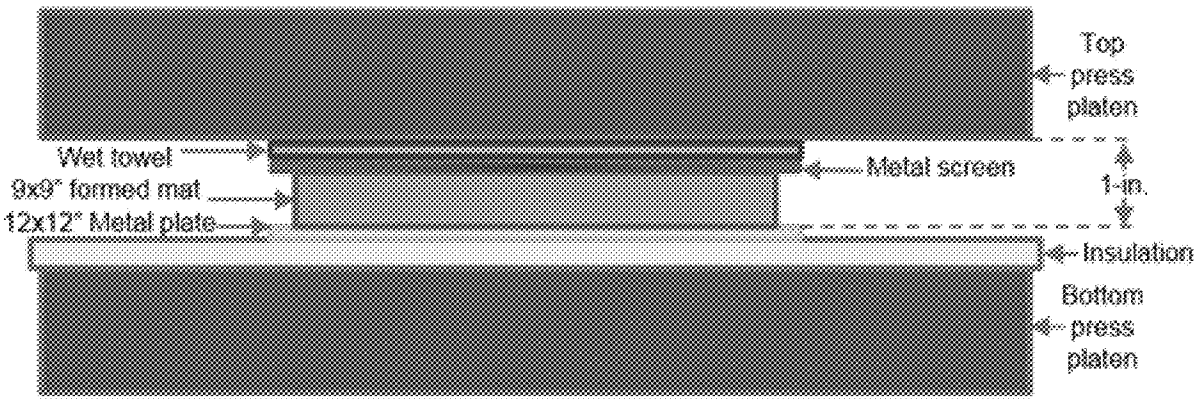
FIG. 2 is showing the equipment used in the laboratory to prove the concept of the present invention.

The assembly to imitate steam ironing process is schematically shown in FIG. 2, where mat of wood flakes blended with a given amount of liquid pmdi adhesive is placed on a metal sheet, the mat is covered by a steel screen on top of which wet cloth is placed containing a given amount of water, to be converted to steam by contact with the top heat platen when the latter is lowered down to partially compress the mat and evaporate the water in the wet cloth (towel). The steam thereby generated has no escape but to go into the mat simulating steam ironing process. After a predetermined contact time, the top platen is raised, the screen and cloth lifted off of the mat and the mat is sprayed with a given amount of release solution (defined in terms of grams/square meter of mat surface). Following this the mat is subjected to a regular press cycle and the resulting OSB sample is compared to the one produced without stem-ironing step. In some experiments a delay between steaming and pressing was introduced to account for 3 minutes that the release sprayed mat is spending on average in the so-called "pre-loader" before entering the press. In this case the release spray was applied immediately after steam stage and before the delay. In addition to "steam-iron" step we have used a "dry-iron" step as well, where the test was repeated with no wetting of the cloth has been tested as seen in the subsequent Table 3.

In order to compare results of standard tests in terms of release, the following grading system was used:

TABLE 2

Grading system for evaluating release performance

| Grade | Description |
|---|---|
| 1 (best) | No sticking, board slides off |
| 2 | Tiny sticking, board comes off with slight force |
| 3 | Little sticking, board comes off with minimal force |
| 4 | Strong sticking, board comes off with considerable force |
| 5 (worst) | Very strong sticking, board comes off with significant force |

From Table 3 data below one can see that the use of steam-ironing step has substantially reduced the minimum required release application rate compared to the control samples:

TABLE 3

The Summary of testing flattening (with and without steam) on the minimum release application rate

| Trial | Condition (Summary) | Flattening (Y/N) | Steaming (Y/N) | Steam rate [g/m^2] | Release dosage [g/m^2] | 3-min Delay (Y/N) | Stickiness (Y/N) | Release quality (1, 2 or 3) |
|---|---|---|---|---|---|---|---|---|
| 1 | Control, no delay | N | N | N/A | 5.0 | N | Y | 1.5 |
| 2 | Control, no delay | N | N | N/A | 6.0 | N | N | 1.0 |
| 3 | Flattening with steam, no delay | Y | Y | 101.4 | 2.0 | N | N | 1.0 |
| 4 | Flattening with steam, no delay | Y | Y | 89.9 | 2.0 | N | N | 1.0 |
| 5 | Flattening with steam, delay | Y | Y | 139.7 | 2.0 | Y | N | 1.0 |
| 6 | Flattening with steam, delay | Y | Y | 101.4 | 2.0 | Y | N | 1.0 |
| 7 | Flattening with steam, delay | Y | Y | 82.3 | 2.0 | Y | Y | 2.0 |
| 8 | Flattening with steam, delay | Y | Y | 21.0 | 2.0 | Y | Y | 1.5 |
| 9 | Flattening, no steam, delay | Y | N | N/A | 2.0 | Y | Y | 1.0 |
| 10 | Flattening with steam, delay | Y | Y | 93.8 | 1.0 | Y | N | 1.0 |

TABLE 3-continued

The Summary of testing flattening (with and without steam) on the minimum release application rate

| Trial | Condition (Summary) | Flattening (Y/N) | Steaming (Y/N) | Steam rate [g/m^2] | Release dosage [g/m^2] | 3-min Delay (Y/N) | Stickiness (Y/N) | Release quality (1, 2 or 3) |
|---|---|---|---|---|---|---|---|---|
| 11 | Flattening with steam, delay | Y | Y | 70.8 | 3.0 | Y | N | 1.0 |
| 12 | Control (no flattening), delay | Y | N | N/A | 4.0 | Y | Y | 1.5 |

The next series of tests was conducted by using a regular OSB thickness of 7/16" (18 mm). In addition to evaluating the effect of steam flattening on the release quality, the resulting sample of 7/16" panel was evaluated in terms of possible loss in pmdi effected bonding, which under the conditions of our testing was only possible to be related to the so called internal bond value (IB) which corresponds to the breaking force by pulling of the OSB sample in z-direction.

Having described the invention, modifications will be evident to those skilled in the art without departing from the scope of the invention as defined in the appended claims.

The invention claimed is:

1. A method for making wood particle boards, the method comprising:

forming a layup of resin coated strands, wherein a resin of the resin coated strands is an isocyanate resin, and wherein the layup comprises a top surface;

smoothing, by a steam press, the top surface of the layup, wherein smoothing comprises pre-pressing and steaming the top surface of the layup at the same time thereby forming a pre-pressed layup;

applying a release agent to the smoothed top surface thereby forming a release agent coated top surface;

cutting the pre-pressed layup into panels;

consolidating, by a consolidating press, the panels by contacting a coated top surface of each panel with a metal press platen of the consolidating press thereby forming the wood particle boards; and removing the wood particle boards from the consolidating press, wherein steaming comprises applying a steam dosage per unit area of between 21 g/square meter and 140 g/square meter.

2. The method of claim 1, wherein the top surface of the layup is steamed in order to reduce stickiness of the top surfaces of the panels to metal press platens.

3. The method of claim 1, wherein steaming comprises applying the steam dosage per unit area of between 80 g/square meter and 120 g/square meter.

4. The method of claim 1, wherein the isocyanate resin is a polymeric diphenylmethane diisocyanate (pmdi) resin.

5. The method of claim 1, wherein the wood particle boards are oriented strand boards (OSBs).

6. The method of claim 1, wherein pre-pressing comprises reducing an initial layup height by 50% to 67%.

7. The method of claim 1, further comprising, after applying the release agent and before consolidating, delaying the pre-pressed layup at a loader.

8. The method of claim 7, wherein delaying the pre-pressed layup at the loader comprises delaying the panels so that they spend an average of 3 minutes at the loader.

9. A method for making wood particle boards, the method comprising:

forming a layup of resin coated strands, wherein a resin of the resin coated strands is an adhesive resin capable of adhering to a metal surface of a press platen of a consolidating press, and wherein the layup comprises a top surface;

smoothing, by a steam press, the top surface of the layup, wherein smoothing comprises pre-pressing and steaming the top surface of the layup at the same time thereby forming a pre-pressed layup;

applying a release agent to the smoothed top surface thereby forming a release agent coated top surface;

cutting the pre-pressed layup into panels;

consolidating, by the consolidating press, the panels by contacting a coated top surface of each panel with the press platen of the consolidating press thereby forming the wood particle boards; and removing the wood particle boards from the consolidating press, wherein steaming comprises applying a steam dosage per unit area of between 80 g/square meter and 120 g/square meter, and wherein the top surface of the layup is steamed in order to reduce stickiness of the top surfaces of the panels to press platens.

10. The method of claim 9, wherein the adhesive resin is an isocyanate resin.

11. The method of claim 10, wherein the adhesive resin is a polymeric diphenylmethane diisocyanate (pmdi) resin.

12. The method of claim 9, further comprising, after applying the release agent and before consolidating, delaying the pre-pressed layup at a loader.

13. The method of claim 9, further comprising, after applying the release agent and before consolidating, delaying the pre-pressed layup at a loader so that it spends an average of 3 minutes at the loader.

14. The method of claim 9, wherein pre-pressing comprises reducing an initial layup height by 50% to 67%.

15. A method for making wood particle boards, the method comprising:

forming a layup of resin coated strands, wherein a resin of the resin coated strands is an isocyanate resin, and wherein the layup comprises a top surface;

smoothing, by a steam press, the top surface of the layup, wherein smoothing comprises pre-pressing and steaming the top surface of the layup thereby forming a pre-pressed layup;

applying a release agent to the smoothed top surface thereby forming a release agent coated top surface;

after applying the release agent and before consolidating, delaying the pre-pressed layup at a loader;

cutting the pre-pressed layup into panels;

consolidating, by a consolidating press, the panels by contacting a coated top surface of each panel with a metal press platen of the consolidating press thereby forming the wood particle boards; and removing the wood particle boards from the consolidating press, wherein delaying the pre-pressed layup at the loader comprises delaying the panels so that they spend an average of 3 minutes at the loader.

* * * * *